US005495816A

United States Patent [19]

Sanvito et al.

[11] Patent Number: 5,495,816

[45] Date of Patent: Mar. 5, 1996

[54] MULTI-NEEDLE SEWING MACHINE WITH THREAD TENSION CONTROL

[75] Inventors: Roberto Sanvito, Buccinasco; Franco Marchesi, San Martino Siccomario, both of Italy

[73] Assignee: Rimoldi Necchi S.R.L., Milan, Italy

[21] Appl. No.: 281,750

[22] Filed: Jul. 28, 1994

[30] Foreign Application Priority Data

Sep. 10, 1993 [IT] Italy ..... MI93A1941

[51] Int. Cl.[6] ..... D05B 1/08; D05B 49/00; D05B 47/00

[52] U.S. Cl. ..... 112/165; 112/241; 112/254

[58] Field of Search ..... 112/165, 241, 112/245, 246, 249, 250

[56] References Cited

U.S. PATENT DOCUMENTS

| | | | |
|---|---|---|---|
| 1,085,801 | 2/1914 | De Voe | 112/245 |
| 1,167,634 | 1/1916 | De Voe | 112/245 |
| 1,266,036 | 5/1918 | Molyneux et al. | 112/241 |
| 2,147,006 | 2/1939 | Zablocki | 112/245 |
| 3,368,508 | 2/1968 | Angele | 112/245 |
| 3,641,958 | 2/1972 | Trageser | 112/241 |
| 4,867,083 | 9/1988 | Fietta et al. | 112/165 X |

*Primary Examiner*—Ismael Izaguirre
*Attorney, Agent, or Firm*—Laff, Whitesel, Conte & Saret, Ltd.

[57] ABSTRACT

In a two-needle sewing machine for making an ornamental stitch without a cover stitch, at least one intermediate lug (17) is provided which is disposed in side by side relation with respect to an upper thread take-up (13) engaged to the needle bar (7), said intermediate lug, in the absence of a workpiece (4) on the needle plate (8), is brought to a work position in which it interferes with one of the needle threads (**4*a*, 4*b*) coming from an auxiliary thread take-up (12) being part of a feed unit for the needle threads. In the presence of the intermediate lug (17) in the work position, the orientation of the needle thread (4*a*) intercepted by said intermediate lug is suitably deviated with respect to the upper thread take-up (13), so as to cause a tension release on the needle thread itself during the raising steps of the needles (3*a*, 3**) towards the upper dead center of their reciprocating motion.

16 Claims, 4 Drawing Sheets

MULTI-NEEDLE SEWING MACHINE WITH THREAD TENSION CONTROL

BACKGROUND OF THE INVENTION

1. Field of the Invention

The present invention relates to a device to form a continuous chain in multi-needle sewing machines for making an ornamental sticth without a cover stitch, of the type comprising: at least two sewing needles carrying respective needle threads and operating through a needle plate upon command of a needle bar operable with a reciprocating motion; a lower looper alternately movable under the needle plate to interlace a corresponding interconnecting thread with said needle threads; a feed unit for the needle threads arranged to feed the needle threads according to a predetermined tensioning towards said needles; an upper thread take-up fastened to the top of the needle bar and operatively engaging the needle threads in order to take up a predetermined amount of thread from the feed unit at every cycle of the needle bar reciprocating movement; means intervening on at least one of said needle threads to release the predetermined tensioning of same.

In the embodiment herein described, the invention aims at executing a continuous chain by means of sewing machines adapted to carry out seams of the type marked by No. 406 in the related U.S. Federal Catalogue No. 751. Obviously, the innovatory principles proposed by the invention can also apply for the purpose of enabling or facilitating the execution of a chain with other types of seam.

2. Prior Art

It is known that when seams are to be made the possibility of an idle operation of the sewing machine is generally required, so that, even in the absence of a workpiece under the presser foot, the cooperation between the different sewing instrumentalities such as needles and loopers may at all events cause a correct interlooping of the sewing threads, giving thereby origin to a continuous chain adapted to be gradually moved away from the working area by means of the feed dogs, without the occurence of undesired entanglements of the threads or other inconveniences.

It is pointed out, however, that in sewing machines provided with two or more needles and designed to execute ornamental stitch seams without cover stitches, as well as other types of multi-needle seams, the chain formation during the idle working steps is very difficult and complicated. In fact, the chain formed with a multi-needle seam, due to its inherent nature, has a very limited structural consistency that does not enable the feed dogs operating under the presser foot to drag it along in a correct manner. As a result, during the idle working steps undesired entanglements and/or breakages of the sewing threads as well as of the needles can easily occur.

In an attempt to solve these problems, different types of devices have been envisaged which are adapted to enable the formation of a continuous chain in multi-needle sewing machines making ornamental stitch seams without cover stitches.

In some of the above devices, such as the one described in French patent issued under No. 2648162, in order to restrain the possibility of thread entanglements in the sewing area, the chain is forced to pass through a narrow slit defined in the needle plate close to the sewing area. Such a slit is such shaped that it exerts a holding action on the chain, so that sliding of the chain itself takes place with a predetermined friction. It is to be pointed out, however, that the devices of this type have proved to be unsatisfactory in terms of operating reliability, in that the efficiency of same is greatly affected by many variable parameters such as for example the material and sizes of the threads used, their degree of humidity and still other values.

In another technical solution described in the Italian Patent No. 1077525 it is essentially provided that in the absence of a workpiece under the presser foot, the selective intervention of one or more actuators acting on the plates of the thread tension members usually provided in the sewing machine is caused, in order to release or eliminate tensioning of one or more threads associated with the needles. In particular, when an ornamental stitch without a cover stitch is to be executed with a two-needle machine, provision is made for the thread of the outer needle, that is the one designed to operate closer to the fabric edge, to be slackened. Slackening or tension release on the needle thread causes the latter to be obliquely deviated, instead of keeping an aligned positioning in the extension of the corresponding needle, when the lower looper, on carrying out the usual reciprocating transverse movement, is inserted into the loops formed by the needle threads when the needles are carrying out their upward stroke. The needle thread deviation from its normal position causes said thread to be newly interlooped by the corresponding needle while the subsequent sewing stitch is being made. Under this circumstance, the chain is made in the form of a cord and, due to its structural features in terms of consistency and compactness, the correct dragging along of said chain by the feed dogs is promoted.

However, even with the use of devices based on the above principle, many problems arise as regards efficiency and operating reliability and, as a result, frequent breakages of the chain while it is formed and/or entanglements of the sewing threads occur.

It has been found that said problems originate essentially from the fact that the needle thread tensioning reduction or release is advantageous as regards the possibility of deviating the thread orientation while the needles are moving upwardly, but it is as much disadvantageous during all the other stitch formation steps where for the engagement of the individual threads by the sewing members the threads are required to be carefully tensioned so that they may keep a positioning as precise as possible.

Therefore it has been found necessary to release the needle thread tensioning during the needle raising step alone, tensioning being restored to the usual value during all the other stitch formation steps. On the other hand, the possibility of meeting the above requirement by means of the usual devices directly intervening on the thread extension members is unthinkable, in that the releasing step and the step for restoring the thrust action between the plates arranged therein would have to take place at very high rates, which is inconsistent with the mechanical features of such members.

SUMMARY OF THE INVENTION

In accordance with the present invention, the problems of the known art are solved by intervening close to the upper thread take-up arranged on the needle bar, so that, by suitably deviating the path travelled over by the needle thread to be released, a tension reduction or release may be achieved on said thread in the needle raising step alone.

In particular, the invention relates to a device to form a continuous stitch in multi-needle sewing machines for making an ornamental stitch without a cover stitch, wherein said intervening means comprises at least one intermediate lug disposed operatively in side by side relation with the needle bar and selectively movable between a rest position in which said needle threads exhibit a predetermined orientation relative to the upper thread take-up and a work position in which said intermediate lug selectively intercepts one of the needle threads close to the upper thread take-up, deviating the extension of the needle thread relative to said predetermined orientation in order to release the needle thread tension during the movement of the needles towards the upper dead center of their reciprocating motion.

BRIEF DESCRIPTION OF THE DRAWINGS

The description of a preferred embodiment of the invention will be given hereinafter by way of nonlimiting example with reference to the accompanying drawings, in which.

DESCRIPTION OF THE PREFERRED EMBODIMENT

Figure 1:
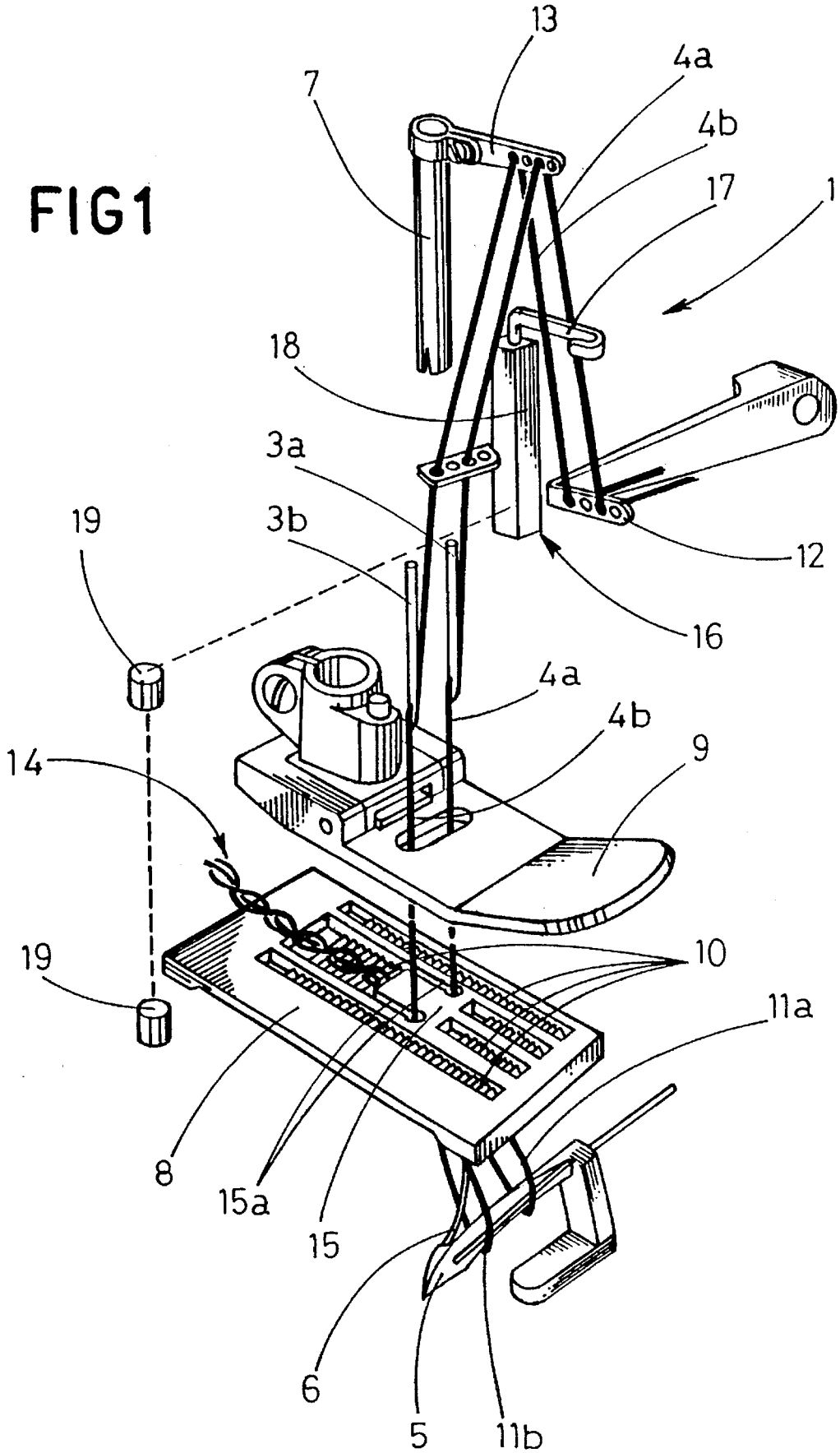
FIG. 1 is a partial perspective view showing the device in reference associated with different members of a conventional sewing machine for executing an ornamental stitch without cover stitch and adapted to make a two-needle chain.

Referring to the drawings, a device to form a continuous chain in multi-needle sewing machines for making an ornamental stitch without a cover stitch, in accordance with the present invention, has been generally identified by reference numeral 1.

The device 1 is associated with conventional sewing machine, of which only those members that operatively cooperate with the device have been shown, all the other members not shown being known per se and conventional and at all events not of importance to the ends of the invention.

Figure 2:
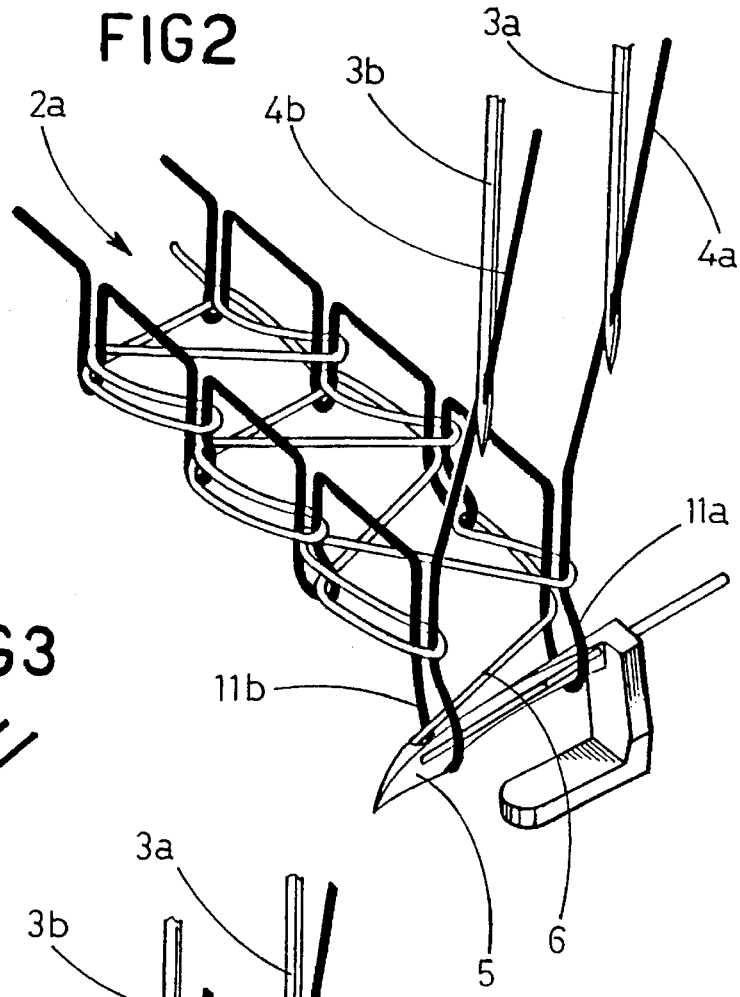
FIG. 2 is a diagrammatic perspective view showing the chain formation when a normal seam is carried out on a workpiece.

Referring particularly to the embodiment shown in FIGS. 1 to 5, the sewing machine with which the device 1 is associated lends itself to carry out a two-needle seam 2*a* providing an ornamental stitch without a cover stitch. As shown in FIG. 2, in the normal sewing steps said ornamental stitch is carried out, on a workpiece 2 shown by way of example in FIG. 5, by means of a first and a second needle, 3*a* and 3*b*, identified as "outer needle" and "inner needle" respectively, which are provided with first and second needle threads 4*a*, 4*b* and cooperate with a lower looper 5 having its own interconnecting thread 6 as well.

Needles 3*a*, 3*b*, fastened to the lower end of a needle bar 7 driven in a vertical reciprocating motion, alternately move through a needle plate 8 along which the workpiece is advanced, upon the action of feed dogs 10 (FIG. 1) being elastically pressed by a presser foot 9.

The lower looper 5, in turn, is conventionally operated in a horizontal reciprocating motion transversely to the feed direction of the workpiece 2, under the needle plate 8. In a manner known per se, when the needles 3*a*, 3*b*, having reached a lower dead point in their reciprocating motion, begin their raisins stroke, the looper 5 is inserted into the loops 11*a*, 11*b* formed lowermost by the needle threads 4*a*, 4*b*, in order to retain said loops as shown in FIG. 2. This situation goes on until the needles 3*a*, 3*b*, by a new downward stroke, enter each an ideal triangle defined between the looper blade 5, the interconnecting thread 6 and the corresponding needle thread 4*a*, 4*b*. Then the stitch closure takes place by withdrawing the looper 5 from the loops 11*a*, 11*b* and the formation of a new stitch occurs by inserting the looper again into the new loops formed by the needle threads 4*a*, 4*b* during the initial raising stroke of needles 3*a*, 3*b*.

Still in a manner known per se, the supply of the needles 3*a*, 3*b* with the corresponding needle threads 4*a*, 4*b* takes place by an appropriate thread supplying and tensioning unit, not shown in detail as known per se and conventional, which is capable of giving the threads a predetermined tensioning, which is fundamental for a correct execution of a seam. In the embodiment shown, said supplying and tensioning unit comprises a known thread tensioning means an auxiliary oscillations thread take-up 12 reciprocated with an oscillating motion close to the head 12*a* (FIG. 6) of the sewing machine. Said auxiliary oscillating thread take-up 12 cooperates with an upper thread take-up 13 fastened on the upper part of the needle bar 7 in order to supply the needles 3*a*, 3*b* with said threads according to a predetermined amount and tension, at each stitch-forming operating cycle. In greater detail, the auxiliary oscillating thread take-up 12 substantially executes a vertical oscillating movement concordant with the needle bar oscillation. During its own lowering stroke, the auxiliary thread take-up 12 takes up the desired amount of thread and supplies it, during its raising stroke, to the upper thread take-up 13.

The foregoing being stated, it is pointed out that at the end of a seam on the workpiece and/or before the beginning of a new seam, the sewing machine is subjected to execute several sewing stitches working "idly", that is in the absence of the workpiece 2 between the needle plate 8 and presser foot 9. It is provided that under this situation the interlacing of the needle threads 4*a*, 4*b* with the interconnecting thread 6 will give origin to a trailing chain, generally denoted by 14 in FIGS. 1 and 4. More particularly, such a chain 14 is formed under a tab 15 defined in the needle plate 8, between two longitudinal slits 15*a* through which the needles 3*a*, 3*b* pass and it emerges on the needle plate, downstream of the tab 15, to be moved away from the sewing area upon the action of the feed dogs 10.

It is to be pointed out however that, should interlacing between the needle threads 4*a*, 4*b* and the interconnecting thread 6 take place in the same manner as described with reference to the sewing step, it would be practically impossible to achieve a reliable formation of the chain 14 in a continuous manner. In fact, in this circumstance the chain-forming threads would be too slack with respect to each other so that they would be unable to ensure a sufficiently reliable engagement of the chain by the feed dogs 10.

In this connection, the inventive device 1 lends itself to intervene during the idle-operation steps in order to modify the chain-formation modalities so as to ensure an appropriate structural consistency and a reliable engagement of the chain with the different members of the sewing machine.

To this end, the device 1 comprises means 16 adapted to act on at least one of the needle threads 4*a*, 4*b* so as to selectively release tension of same during the idle sewing steps.

In greater detail, this thread tension releasing means 16 in an original manner comprises at least one intermediate lug 17 disposed operatively in side by side relation with the needle bar 7 and selectively movable up-and-down, according to a trajectory for example substantially parallel to the movement direction of the needle bar itself, upon command of a fluid-operated actuator 18 or equivalent means adapted to selectively dispose the intermediate lug to a rest position and a work position. In the rest position the intermediate lug 17 is located in parallel side by side relation with the upper thread take-up 13 when the latter is at the lower dead point of the reciprocating motion imparted to it by the needle bar 7. In this condition the intermediate lug 17 has no interference in the movement of the needle threads 4*a*, 4*b* by the upper and auxiliary thread take-ups 13 and 12, so that both the needle threads, in respect of the upper thread take-up 13, have a predetermined orientation adapted to enable execution of the usual sewing steps, according to the preceding description.

Simultaneously with the idle operation imposed to the sewing machine at the end of a normal seam and/or before the beginning of a seam on a new workpiece, a fluid-operated actuator 18 causes the displacement of the intermediate lug 17 to the work position. In this connection, the use of a photoelectric sensor 19 (FIG. 1) may be advantageously provided, which sensor is interlocked to the actuator 18 and which acts close to the needle plate 8 in order to activate said actuator in the absence of a workpiece 2 on the needle plate. Alternatively, activation of the actuator 18 may be driven for example by the operator, through a knee-piece for example or similar mechanical drive devices.

In its work position, the intermediate lug 17 is located parallelly to the upper thread take-up 13 at a substantially intermediate height between the lower dead point and the upper dead center of the reciprocating motion of said upper thread carried by said needle bar 7.

In this position, the intermediate lug 17 selectively interferes with the intercept of one of the needle threads, and in particular the first needle thread 4*a* associated with the outer needle 3*a*, so that the thread is suitably deviated in respect of said predetermined orientation, with reference to the normal sewing step.

Figure 3:
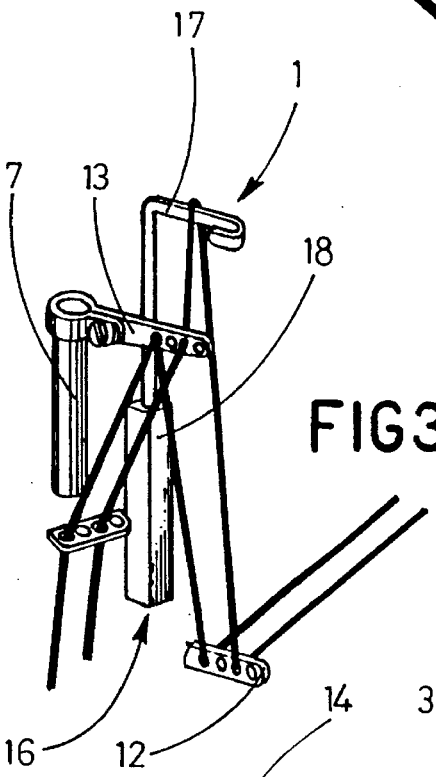
FIG. 3 is a fragmentary perspective view of a detail of the device in reference with a corresponding intermediate lug in an operating position.

It is to be noted that the interference of the intermediate lug 17 with the first needle thread 4*a* takes place cyclically only in the lowering strokes of the needle bar 7 towards the lower dead center of its reciprocating motion. Therefore, during each lowering strokes of the needle bar 7 the upper thread take-up 13 will be subjected to take up a greater amount of thread from the auxiliary thread take-up 12, than the amount present at the second needle thread 4*b* which, as clearly shown in FIG. 3, is disengaged from the intermediate lug 17.

Therefore, as soon as the needle bar 7, and consequently the upper thread take-up 13, moves up, away from the lower dead center, thereby reducing its distance from the intermediate lug 17, a reduction or release in the tension present until now along the first needle thread 4*a* occurs, whereas the second needle thread 4*b* keeps the foreseen tensioning.

Under this situation, the loop 11*a* of the first needle thread 4*a*, instead of keeping an orientation substantially parallel to that of the loop 11*b* formed by the second needle thread 4*b*, is dragged along in the movement carried out by the looper 5 performing its going stroke during the upward stroke of the needles 3*a*, 3*b*. As clearly shown in FIG. 4, the loop 11*a* of the first needle thread 4*a* is thus moved close to the loop 11*b* of the second needle thread 4*b*.

The first needle thread 4*a* is therefore disposed so that the first needle 3*a*, while carrying out its downward stroke, cannot enter the triangle formed by the thread itself with the looper 5 and interconnecting thread 6. The first needle 3*a*, or right-hand needle, will be therefore liable to carry out a series of idle stitches.

Figure 4:
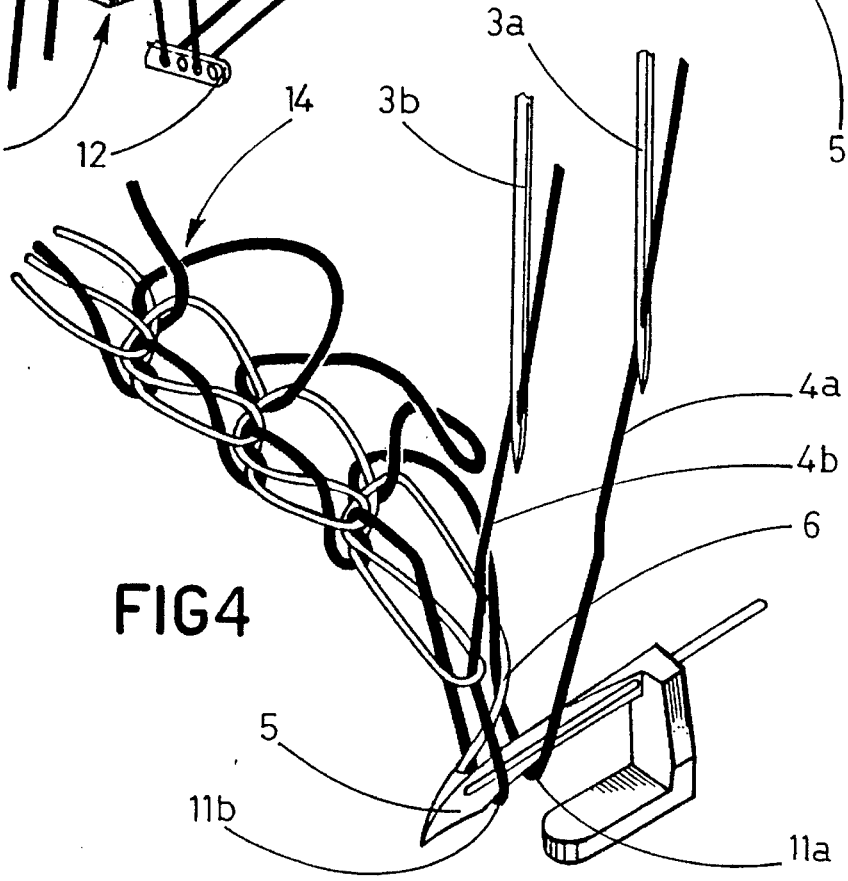
FIG. 4 is a diagram showing the formation of a continuous chain during the idle operation of the machine.

Under this situation the sewing chain 14 will be made in the form of a cord, as shown in FIG. 4, having a structural consistency capable of ensuring the efficient engagement of same by the feed dogs 10 and/or other members usually provided in sewing machines.

It will be noted that tensioning of the first needle thread 4*a* is restored according to the predetermined value in the final step of the needle plate upward stroke, when the upper thread take-up 13 moves away again from the intermediate lug 17. As a result, tension release on the first needle thread 4*a* exclusively occurs during the initial raising step of the needles 3*a*, 3*b*, when the thread loop 11*a* is to be moved by the looper 5. On the contrary, during all the other steps provided in the stitch-forming operating cycle, tensioning of the first needle thread 4*a* keeps the previously established value for a normal sewing step.

Thus the risk that the absence of tensioning on the first needle thread 4*a* over the whole duration of a stitch formation cycle may give rise to entanglements between the needles 4*a*, 4*b*, 6 is eliminated and, as a result, no breakings in the chain 14 or working stoppages occur.

Figure 5:
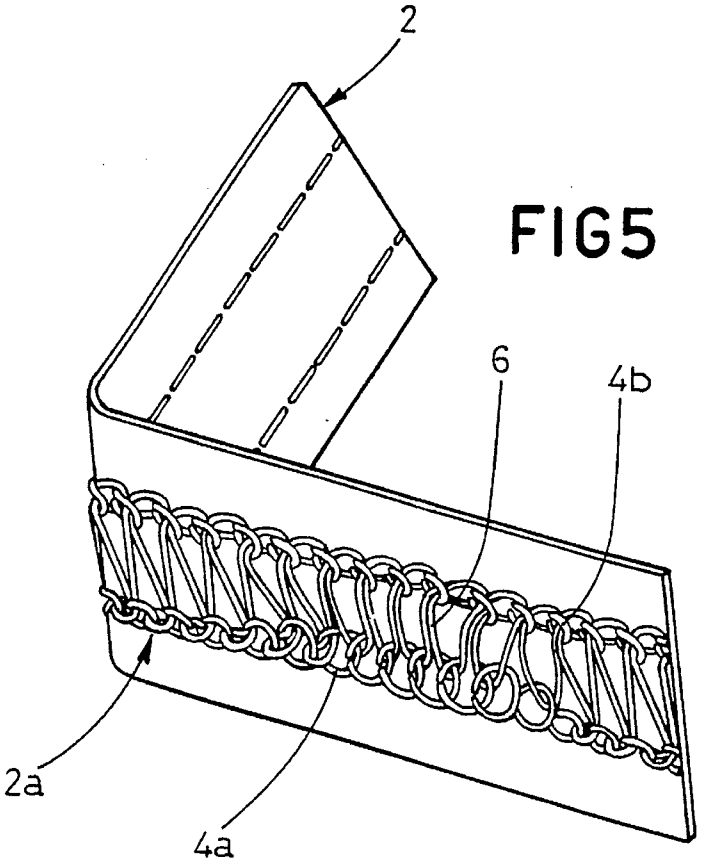
FIG. 5 is a perspective view showing, just as an indication, the effects produced on a seam executed on a workpiece following the intervention of the device in question on one of the needle threads.

Just as an indication, FIG. 5 shows how a seam 2*a* carried out on the workpiece 2 looks, if the intermediate lug 17 is intentionally brought to a work position while a seam length is being executed. As can be seen from said figure, in the seam length where the intervention of the intermediate lug 17 has occurred an important widening of the loops formed by the first needle thread 4*a* can be seen, whereas interlacing of the second needle thread 4*b* with the interconnecting thread 6 remains unchanged over the whole seam progress.

Obviously in some types of sewing machines and/or in order to meet particular requirements the intermediate lug 17 may be such arranged that it operates on the second sewing thread 4*b* associated with the inner or left-hand needle 3*b*, instead of on the first sewing thread 4*a*.

Figure 6:
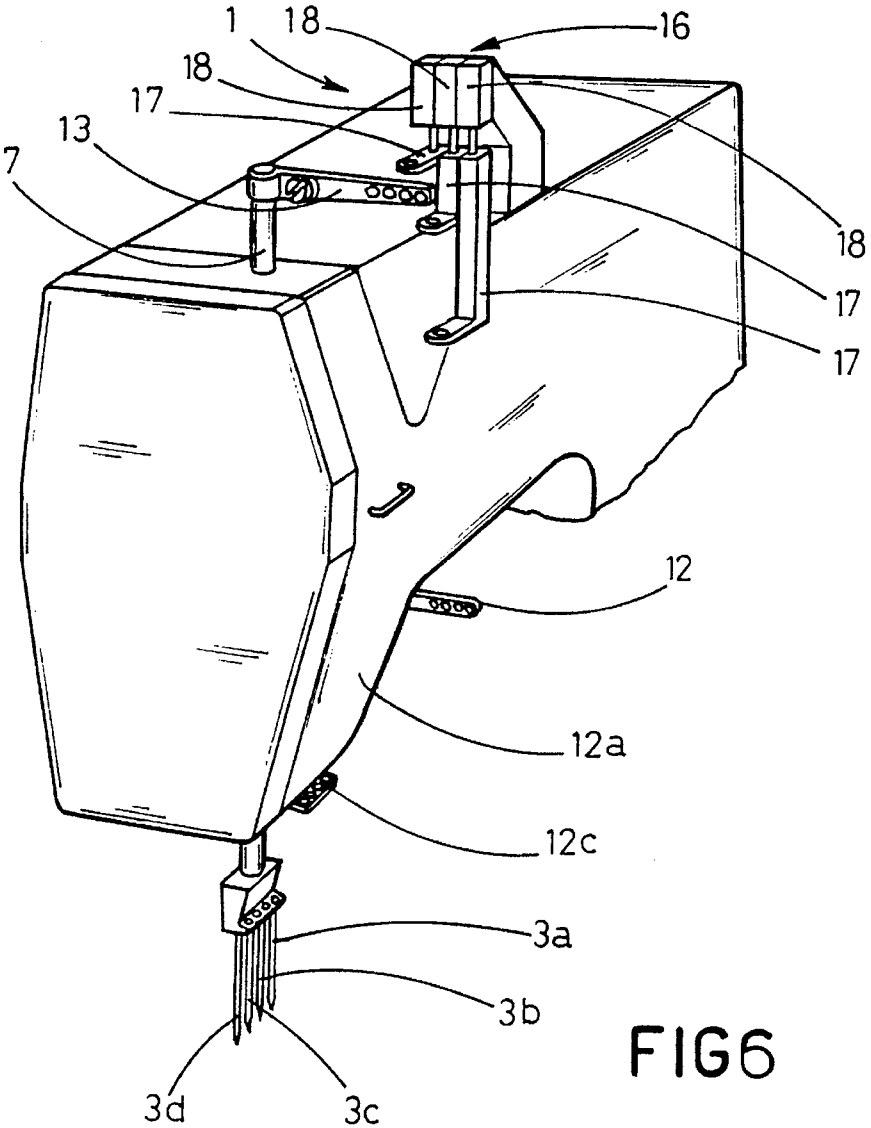
FIG. 6 shows an alternative embodiment of the device in question designed to make seams using more than two needles.

Shown in FIG. 6 is an alternative embodiment of the device in question, adapted to operate on a sewing machine provided with four needles 3*a*, 3*b*, 3*c*, 3*d*. In this case three intermediate lugs 17 are provided and they are designed to interact with the corresponding needle threads, with the exception of the one associated with the innermost needle 3*d*.

Figure 6A:
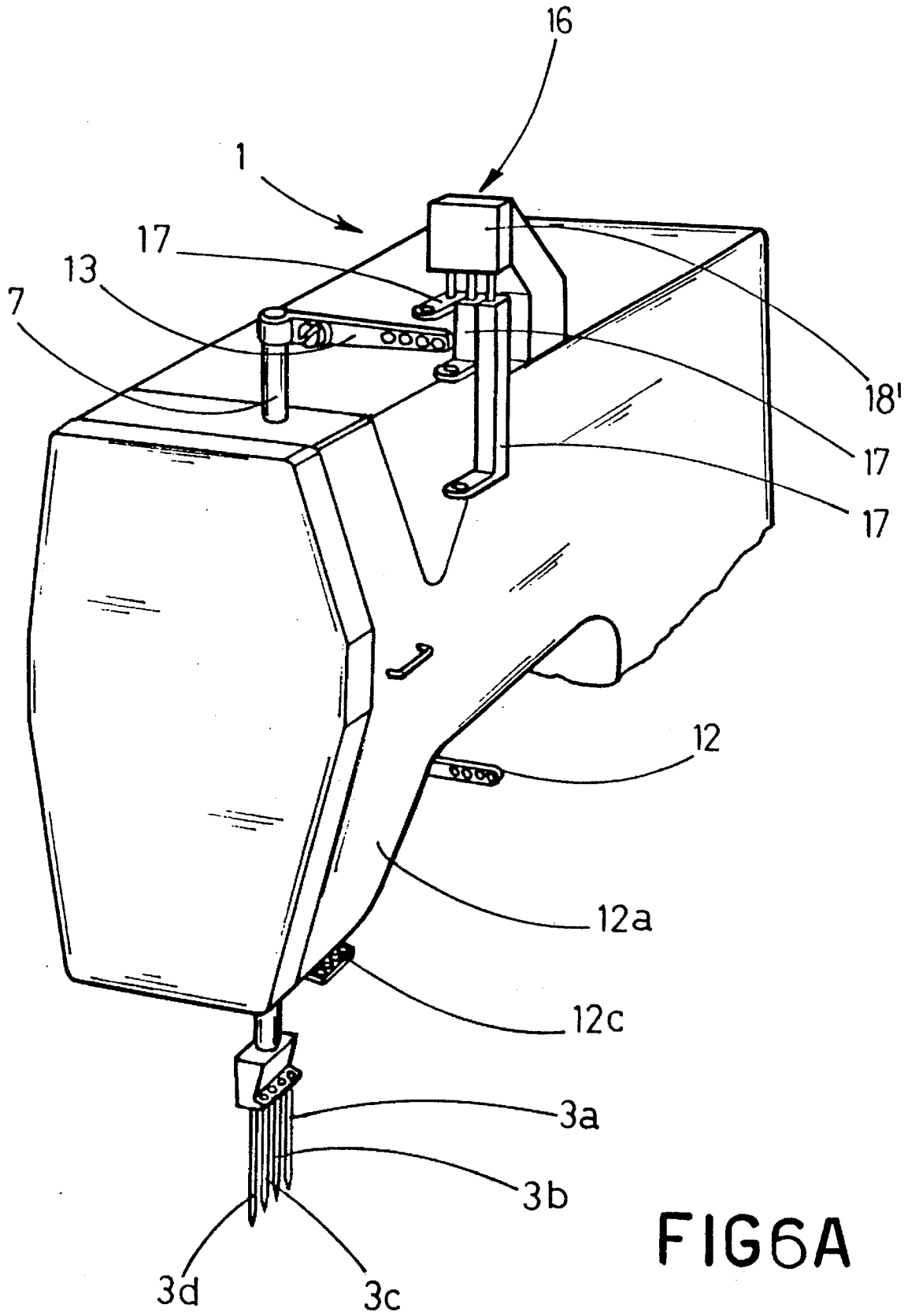
FIG. 6A shows a further alternative embodiment of the device for making seams.

Advantageously, a fluid-operated actuator 18 may be provided for each of the intermediate lugs 17, so that said lugs may be individually driven according to displacements of predetermined amplitude in order to cause slackening of the corresponding needle thread to the exact extent. Alternatively, a single fluid-operated actuator 18' (shown in FIG. 6A) may be arranged and it will simultaneously act on all the intermediate lugs 17. In this case adjustment of the slackening produced on the individual needle threads can be carried out by positioning the individual intermediate lugs 17 to different distances from the upper thread take-up 13.

In combination with each intermediate lug 17, provision may be also made for at least one fixed thread guide 12*c* designed to guide the respective needle thread in order to maintain the predetermined orientation of same when the corresponding intermediate lug is in its rest position.

The present invention attains the intended purposes.

In is found in fact that tension releasing of the needle thread or threads exclusively achieved during the needle upward strokes causes the elimination of the risk of entanglements both at the produced chain and with reference to the sewing threads concerned with the needle and/or looper action.

The great operating reliability given to the sewing machine during the idle sewing steps advantageously makes it possible to carry out continuous workings, when mass production is concerned, since the sewing machine can be maintained in operation even in the transition periods between the end of a working on a workpiece and the beginning of a working on the following workpiece.

Obviously, many modifications and variations may be made to the sewing machine as conceived without departing from the scope of the invention as characterized by the appended claims.

What is claimed is:

1. A device to form a continuous chain in a multi-needle sewing machine for making an ornamental stitch without a cover stitch, said sewing machine having:

at least two sewing needles (3*a*, 3*b*) to carry needle threads (4*a*, 4*b*), a needle plate (8), a reciprocating needle bar (7), a lower looper (5), said lower looper being positioned under the needle plate (8) to interlace an interconnecting thread (6) with said needle threads (4*a*, 4*b*);

a feed unit positioned to feed the needle threads (4*a*, 4*b*) to said needles (3*a*, 3*b*);

an upper thread take-up (13) fastened to a top of the needle bar (7) and positioned to operatively receive the needle threads (4*a*, 4*b*) in order to take up a predetermined amount of thread from the feed unit at every reciprocating cycle of the needle bar said device comprising;

intervening means (16) to engage at least one of said needle threads (4*a*) to release tension on said at least one needle thread (4*a*), said intervening means (16) has at least one intermediate lug (17) positioned in side by side relation with the needle bar (7), said intermediate lug (17) being independently selectively movable between a rest position in which said needle threads (4*a*, 4*b*) exhibit a predetermined orientation relative to the upper thread take-up (13) and a work position in which said intermediate lug (17) engages said at least one needle thread (4*a*) close to said upper thread take-up (13) to move a portion of said at least one needle thread (4*a*) relative to said predetermined orientation to release tension on said at least one needle thread (4*a*) during the movement of the needle bar (7) towards a needle bar upper dead position from a needle bar lower dead position;

said intermediate lug (17) engages said at least one needle thread (4*a*) when said needle bar (7) is lowered towards the needle bar lower dead position, and the feed unit has an auxiliary thread take-up (12) driven with an oscillatory motion for cyclically supplying needle threads (4*a*, 4*b*) to the upper thread take-up (13) during movement of the needle bar (7) towards the needle bar upper dead position.

2. The device as claimed in claim 1, wherein in said rest position said intermediate lug (17) is disposed in side by side relation with the upper thread take-up (13) at the needle bar lower dead position.

3. The device as claimed in claim 2, further comprising a fluid-operated actuator (18), at least one photoelectric sensor (19) connected to said actuator (18), said at least one photoelectric sensor being positioned close to said needle plate (8) to activate said fluid-operated actuator (18) when there is no workpiece (2) on said needle plate (8).

4. The device as claimed in claim 1, further comprising a fluid-operated actuator (18), at least one photoelectric sensor (19) connected to said actuator, said at least one photoelectric sensor being positioned close to the needle plate (8) in order to drive the intermediate lugs (17).

5. The device as claimed in claim 1, comprising a plurality of intermediate lugs (17) operating each on a respective needle thread in order to interfere with said respective needle thread for releasing the thread tension.

6. The device as claimed in claim 5 wherein, said intermediate lugs (17) are simultaneously movable between the respective test and work positions by said fluid-operated actuator (18).

7. A device to form a continuous chain in a multi-needle sewing machine for making an ornamental stitch without a cover stitch, said sewing machine having:

at least two sewing needles (3*a*, 3*b*) to carry needle threads (4*a*, 4*b*), a needle plate (8), a reciprocating needle bar (7), a lower looper (5), said lower looper being positioned under the needle plate (8) to interlace an interconnecting thread (6) with said needle threads (4*a*, 4*b*);

a feed unit positioned to feed the needle threads (4*a*, 4*b*) to said needles (3*a*, 3*b*);

an upper thread take-up (13) fastened to a top of the needle bar (7) and positioned to operatively receive the needle threads (4*a*, 4*b*) in order to take up a predetermined amount of thread from the feed unit at every reciprocating cycle of the needle bar said device comprising;

intervening means (16) to engage at least one of said needle threads (4*a*) to release tension on said at least one needle thread (4*a*), said intervening means (16) has at least one intermediate lug (17) positioned in side by side relation with the needle bar (7), said intermediate lug 17 being independently selectively movable between a rest position in which said needle threads (4*a*, 4*b*) exhibit a predetermined orientation relative to the upper thread take-up (13) and a work position in which said intermediate lug (17) engages said at least one needle thread (4*a*) close to said upper thread take-up (13) to move a portion of said at least one needle thread (4*a*) relative to said predetermined orientation to release tension on said at least one needle thread (4*a*) during the movement of the needle bar (7) towards a needle bar upper dead position and during movement of the needle bar when the needle bar is lowered to a needle bar lower dead position, at least one fluid-operated actuator (18') for driving the at least one intermediate lug (17) between said rest and work position, at least one stationary thread guide arranged for guiding the corresponding needle thread when said intermediate lug (17) is in its rest position; and said stationary guide being mounted on said sewing machine.

8. A device to form a continuous chain in multi-needle sewing machines for making an ornamental stitch without a cover stitch, said sewing machine comprising:

at least two sewing needles (3*a*, 3*b*) carrying respective needle threads (4*a*, 4*b*) and operating through a needle plate (8), a vertical reciprocating needle bar 7, said needles (3*a*, 3*b*) being fastened to a lower portion of said needle bar, a lower looper (5) having its own interconnecting thread (6), said lower looper movable with a horizontal reciprocating motion and being positioned under said needle plate (8) to interlace said interconnecting thread (6) with the needle threads (4*a*, 4*b*);

a thread supply and tension unit for supplying the needle threads (4*a*, 4*b*) at a predetermined tension to said needles (3*a*, 3*b*), an upper thread take-up (13) fastened to an upper portion of said needle bar (7), and positioned to operatively engage the needle threads (4*a*, 4*b*) in order to take up a predetermined amount of thread from said thread supply and tension unit at every cycle of the needle bar reciprocating movement;

a thread tension releasing means (16) to engage at least one of said needle thread (4*a*) to release said predetermined tension of said at least one needle thread (4*a*), said thread tension releasing means (16) comprising at least one intermediate lug (17) disposed operatively in side by side relation with said needle bar (7) and selectively movable between a rest position and a work position; said rest position being a position in which said at least one needle thread (4*a*) is free from interference from said intermediate lug (17); said work position being a position in which said intermediate lug (17) engages with said at least one needle thread (4*a*) during the movement of said needle bar (7) towards a needle bar lower dead point, and in which the movement of said needle bar (7) towards a needle bar upper dead point releases the needle thread tension; said movement of the intermediate lug (17) between the rest and work positions taking place on an axis substantially parallel to the movement axis of the needle bar (7).

9. The device as claimed 8, wherein said thread supplying and tensioning unit comprises an auxiliary thread take-up (12) driven with an oscillatory motion to cyclically supply the upper thread take-up (13) with the needle threads (4*a*, 4*b*) during movement of said needle bar towards said needle bar upper dead point.

10. The device as claimed in claim 9 wherein in its work position the intermediate lug (17) is positioned in respect to said upper thread take-up (13) at a substantially intermediate height between the lower dead point and the upper dead point of the reciprocating motion imparted to said upper thread take-up by the needle bar (7).

11. The device as claimed in claim 10, wherein in its rest position said intermediate lug (17) is disposed in side by side relation with the upper thread take-up (13) at the lower dead point of the reciprocating motion imparted to said upper thread take-up by said needle bar (7).

12. The device as claimed in claim 8, wherein movement of the intermediate lug (17) between its own rest and work positions is caused by a fluid-operated actuator (18) interlocked to at least one photoelectric sensor (19) operating close to the needle plate (8); said photoelectric sensor (19) activating said fluid-operated actuator (18) when there is no workpiece (2) on said needle plate (8).

13. The device as claimed in claim 8, comprising a plurality of said intermediate lugs (17) operating each on a respective needle thread in order to interfere with said respective needle thread for releasing the thread tension.

14. The device as claimed in claim 13 wherein a plurality of fluid-operated actuators (18) acting each on one of said intermediate lugs (17) are provided for causing the selective displacement of said intermediate lug (17) between its own rest and work positions.

15. The device as claimed in claim 14, wherein said intermediate lugs (17) are simultaneously movable between the respective rest and work positions by a single fluid-operated actuator (18).

16. The device as claimed in claim 8, wherein combined with a intermediate lug (17) is at least one stationary thread guide arranged for guiding the corresponding needle thread when said intermediate lug (17) is in its rest position; said stationary guide being mounted on said sewing machine.

* * * * *

UNITED STATES PATENT AND TRADEMARK OFFICE

CERTIFICATE OF CORRECTION

PATENT NO. : 5,495,816

DATED : Mar. 5, 1996

INVENTOR(S) : Roberto Sanvito and Franco Marchesi

It is certified that error appears in the above-indentified patent and that said Letters Patent is hereby corrected as shown below:

Column 8, line 22, delete "test" and insert --rest--.

Signed and Sealed this

Twentieth Day of August, 1996

*Attest:*

BRUCE LEHMAN

*Attesting Officer*

*Commissioner of Patents and Trademarks*